US010047996B2

(12) United States Patent
Boarman et al.

(10) Patent No.: US 10,047,996 B2
(45) Date of Patent: Aug. 14, 2018

(54) MULTI-SHEET SPHERICAL ICE MAKING

(71) Applicant: WHIRLPOOL CORPORATION, Benton Harbor, MI (US)

(72) Inventors: Patrick J. Boarman, Evansville, IN (US); Brian K. Culley, Evansvile, IN (US); Gregory G. Hortin, Henderson, KY (US)

(73) Assignee: Whirlpool Corporation, Benton Harbor, MI (US)

( * ) Notice: Subject to any disclaimer, the term of this patent is extended or adjusted under 35 U.S.C. 154(b) by 0 days.

(21) Appl. No.: 15/292,637

(22) Filed: Oct. 13, 2016

(65) Prior Publication Data

US 2017/0030624 A1 Feb. 2, 2017

Related U.S. Application Data

(62) Division of application No. 13/713,160, filed on Dec. 13, 2012, now Pat. No. 9,518,770.

(51) Int. Cl.

| | |
|---|---|
| ***F25C 1/18*** | (2006.01) |
| ***F25C 1/12*** | (2006.01) |
| ***F25C 5/14*** | (2006.01) |

(52) U.S. Cl.

CPC ..... *F25C 1/18* (2013.01); *F25C 1/12* (2013.01); *F25C 5/14* (2013.01)

(58) Field of Classification Search

CPC ..... F25C 1/12; F25C 5/14; F25C 5/16; F25C 2300/00; F25C 2301/00; F25C 2400/06

See application file for complete search history.

(56) References Cited

U.S. PATENT DOCUMENTS

| | | | |
|---|---|---|---|
| 275,192 | A | 12/1882 | Goodell |
| 286,604 | A | 10/1883 | Goodell |
| 301,539 | A | 7/1884 | Vezin |

(Continued)

FOREIGN PATENT DOCUMENTS

| | | | |
|---|---|---|---|
| AU | 2006201786 | A1 | 11/2007 |
| CN | 1989379 | A | 6/2007 |

(Continued)

OTHER PUBLICATIONS

Daehn, "High-Velocity Metal Forming," ASM Handbook, 2006, pp. 405-418, vol. 14B, ASM International.

(Continued)

*Primary Examiner* — Cassey D Bauer
(74) *Attorney, Agent, or Firm* — Price Heneveld LLP

(57) ABSTRACT

An ice maker is provided herein that includes an evaporator plate. A first side of the evaporator plate is adapted to form a first clear ice sheet and a second side of the evaporator plate is adapted to form a second clear ice sheet. A staging area is arranged downstream from the evaporator plate and adapted to receive the first and second clear ice sheets after formation. The first and second clear ice sheets are fused in the staging area to form a unitary ice sheet. A first mold assembly having a first mold form and a second mold assembly having a second mold form are positioned within the staging area on opposite sides of the unitary ice sheet when the unitary ice sheet is received in the staging area. A mold cavity is adapted to shape the unitary clear ice sheet to form one or more clear ice structures.

20 Claims, 9 Drawing Sheets

(56) References Cited

U.S. PATENT DOCUMENTS 1,407,614 A 2/1922 Wicks
1,616,492 A 2/1927 Lado
1,889,481 A 11/1932 Kennedy, Jr.
1,932,731 A 10/1933 Hathorne
2,027,754 A 1/1936 Smith
2,244,081 A 3/1938 Reeves
2,617,269 A 6/1949 Smith-Johannsen
2,481,525 A 9/1949 Mott
2,757,519 A 2/1954 Sampson
2,846,854 A 2/1954 Galin
2,683,356 A 7/1954 Green
2,878,659 A 7/1955 Prance et al.
2,942,432 A 6/1960 Muffly
2,969,654 A 1/1961 Harle
3,144,755 A 7/1961 Kattis
2,996,895 A 8/1961 Lippincott
3,009,336 A 11/1961 Bayston et al.
3,016,719 A 1/1962 Reindl
3,033,008 A 5/1962 Avis
3,046,753 A 7/1962 Carapico, Jr.
3,071,933 A 1/1963 Shoemaker
3,075,360 A 1/1963 Elfving et al.
3,075,364 A 1/1963 Kniffin
3,084,678 A 4/1963 Lindsay
3,084,878 A 4/1963 Helming et al.
3,093,980 A 6/1963 Frei
3,159,985 A 12/1964 Keighley
3,172,269 A 3/1965 Cole
3,192,726 A 7/1965 Newton
3,200,600 A 8/1965 Elfving
3,214,128 A 10/1965 Beck et al.
3,217,508 A 11/1965 Beck et al.
3,217,510 A 11/1965 Kniffin et al.
3,217,511 A 11/1965 Keighley
3,222,902 A 12/1965 Brejcha et al.
3,228,222 A 1/1966 Maier
3,255,603 A 6/1966 Johnson et al.
3,306,064 A 2/1967 Poolos
3,308,631 A 3/1967 Kniffin
3,318,105 A 5/1967 Burroughs et al.
3,321,932 A 5/1967 Orphey, Jr.
3,383,876 A 5/1968 Frohbieter
3,412,572 A 11/1968 Kesling
3,426,564 A 2/1969 Jansen et al.
3,451,237 A 6/1969 Baringer et al.
3,638,451 A 2/1972 Brandt
3,646,792 A 3/1972 Hertel et al.
3,677,030 A 7/1972 Nicholas
3,684,235 A 8/1972 Schupbach
3,775,992 A 12/1973 Bright
3,788,089 A 1/1974 Graves
3,806,077 A 4/1974 Pietrzak et al.
3,864,933 A 2/1975 Bright
3,892,105 A 7/1975 Bernard
3,908,395 A 9/1975 Hobbs
3,952,539 A 4/1976 Hanson et al.
4,006,605 A 2/1977 Dickson et al.
D244,275 S 5/1977 Gurbin
4,024,744 A 5/1977 Trakhtenberg et al.
4,059,970 A 11/1977 Loeb
4,062,201 A 12/1977 Schumacher et al.
4,078,450 A 3/1978 Vallejos
D249,269 S 9/1978 Pitts
4,142,378 A 3/1979 Bright et al.
4,148,457 A 4/1979 Gurbin
4,184,339 A 1/1980 Wessa
4,222,547 A 9/1980 Lalonde
4,261,182 A 4/1981 Elliott
4,288,497 A 9/1981 Tanaka et al.
4,402,185 A 9/1983 Perchak
4,402,194 A 9/1983 Kuwako et al.
4,412,429 A 11/1983 Kohl
4,462,345 A 7/1984 Routery
4,483,153 A 11/1984 Wallace
4,487,024 A 12/1984 Fletcher et al.
4,550,575 A 11/1985 DeGaynor
4,562,991 A 1/1986 Wu
4,580,410 A * 4/1986 Toya ..... F25C 1/12 62/347
4,587,810 A 5/1986 Fletcher
4,627,946 A 12/1986 Crabtree
4,669,271 A 6/1987 Noel
4,680,943 A 7/1987 Mawby et al.
4,685,304 A 8/1987 Essig
4,688,386 A 8/1987 Lane et al.
4,727,720 A 3/1988 Wernicki
4,843,827 A 7/1989 Peppers
4,852,359 A 8/1989 Manzotti
4,856,463 A 8/1989 Johnston
4,910,974 A 3/1990 Hara
4,942,742 A 7/1990 Burruel
4,970,877 A 11/1990 Dimijian
4,971,737 A 11/1990 Infanti
5,025,756 A 6/1991 Nyc
D318,281 S 7/1991 McKinlay
5,044,600 A 9/1991 Shannon
5,129,237 A 7/1992 Day et al.
5,157,929 A 10/1992 Hotaling
5,177,980 A 1/1993 Kawamoto et al.
5,196,127 A 3/1993 Solell
5,253,487 A 10/1993 Oike
5,257,601 A 11/1993 Coffin
5,272,888 A 12/1993 Fisher et al.
5,372,492 A 12/1994 Yamauchi
5,378,521 A 1/1995 Ogawa et al.
5,400,605 A 3/1995 Jeong
5,408,844 A 4/1995 Stokes
5,425,243 A 6/1995 Sanuki et al.
5,483,929 A 1/1996 Kuhn et al.
5,586,439 A 12/1996 Schlosser et al.
5,617,728 A 4/1997 Kim et al.
5,632,936 A 5/1997 Su et al.
5,618,463 A 8/1997 Rindler et al.
5,675,975 A 10/1997 Lee
5,761,920 A 6/1998 Wilson et al.
5,768,900 A 6/1998 Lee
5,826,320 A 10/1998 Rathke et al.
5,884,487 A 3/1999 Davis et al.
5,884,490 A 3/1999 Whidden
D415,505 S 10/1999 Myers
5,970,725 A 10/1999 Lee
5,970,735 A 10/1999 Hobelsberger
6,058,720 A 5/2000 Ryu
6,062,036 A 5/2000 Hobelsberger
6,101,817 A 8/2000 Watt
6,145,320 A 11/2000 Kim
6,148,620 A 11/2000 Kumagai et al.
6,148,621 A 11/2000 Byczynski et al.
6,161,390 A 12/2000 Kim
6,179,045 B1 1/2001 Lilleaas
6,209,849 B1 4/2001 Dickmeyer
6,282,909 B1 9/2001 Newman et al.
6,289,683 B1 9/2001 Daukas et al.
6,357,720 B1 3/2002 Shapiro et al.
6,427,463 B1 8/2002 James
6,438,988 B1 8/2002 Paskey
6,467,146 B1 10/2002 Herman
6,481,235 B2 11/2002 Kwon
6,647,739 B1 11/2003 Kim et al.
6,688,130 B1 2/2004 Kim
6,688,131 B1 2/2004 Kim et al.
6,735,959 B1 5/2004 Najewicz
6,742,351 B2 6/2004 Kim et al.
6,763,787 B2 7/2004 Hallenstvedt et al.
6,782,706 B2 8/2004 Holmes et al.
D496,374 S 9/2004 Zimmerman
6,817,200 B2 11/2004 Willamor et al.
6,820,433 B2 11/2004 Hwang
6,857,277 B2 2/2005 Somura
6,935,124 B2 8/2005 Takahashi et al.
6,951,113 B1 10/2005 Adamski
D513,019 S 12/2005 Lion et al.
7,010,934 B2 3/2006 Choi et al.
7,010,937 B2 3/2006 Wilkinson et al.

(56) References Cited

U.S. PATENT DOCUMENTS

| | | | |
|---|---|---|---|
| 7,013,654 | B2 | 3/2006 | Tremblay et al. |
| 7,051,541 | B2 | 5/2006 | Chung et al. |
| 7,059,140 | B2 | 6/2006 | Zevlakis |
| 7,062,925 | B2 | 6/2006 | Tsuchikawa et al. |
| 7,062,936 | B2 | 6/2006 | Rand et al. |
| 7,082,782 | B2 | 8/2006 | Schlosser et al. |
| 7,131,280 | B2 | 11/2006 | Voglewede et al. |
| 7,185,508 | B2 | 3/2007 | Voglewede et al. |
| 7,188,479 | B2 | 3/2007 | Anselmino et al. |
| 7,201,014 | B2 | 4/2007 | Hornung |
| 7,204,092 | B2 | 4/2007 | Castrellón et al. |
| 7,210,298 | B2 | 5/2007 | Lin |
| 7,216,490 | B2 | 5/2007 | Joshi |
| 7,216,491 | B2 | 5/2007 | Cole et al. |
| 7,234,423 | B2 | 6/2007 | Lindsay |
| 7,266,973 | B2 | 9/2007 | Anderson et al. |
| 7,297,516 | B2 | 11/2007 | Chapman et al. |
| 7,318,323 | B2 | 1/2008 | Tatsui et al. |
| 7,386,993 | B2 | 6/2008 | Castrellón et al. |
| 7,415,833 | B2 | 8/2008 | Leaver et al. |
| 7,448,863 | B2 | 11/2008 | Yang |
| 7,487,645 | B2 | 2/2009 | Sasaki et al. |
| 7,568,359 | B2 | 8/2009 | Wetekamp et al. |
| 7,587,905 | B2 | 9/2009 | Kopf |
| 7,669,435 | B2 | 3/2010 | Joshi |
| 7,681,406 | B2 | 3/2010 | Cushman et al. |
| 7,703,292 | B2 | 4/2010 | Cook et al. |
| 7,752,859 | B2 | 7/2010 | Lee et al. |
| 7,762,092 | B2 | 7/2010 | Tikhonov et al. |
| 7,802,457 | B2 | 9/2010 | Golovashchenko et al. |
| 7,866,167 | B2 | 1/2011 | Kopf |
| 7,918,105 | B2 | 4/2011 | Kim |
| 8,015,849 | B2 | 9/2011 | Jones et al. |
| 8,037,697 | B2 | 10/2011 | LeClear et al. |
| 8,074,464 | B2 | 12/2011 | Venkatakrishnan et al. |
| 8,099,989 | B2 | 1/2012 | Bradley et al. |
| 8,117,863 | B2 | 2/2012 | Van Meter et al. |
| 8,171,744 | B2 | 5/2012 | Watson et al. |
| 8,281,613 | B2 | 10/2012 | An et al. |
| 8,322,148 | B2 | 12/2012 | Kim et al. |
| 8,336,327 | B2 | 12/2012 | Cole et al. |
| 8,371,133 | B2 | 2/2013 | Kim et al. |
| 8,371,136 | B2 | 2/2013 | Venkatakrishnan et al. |
| 8,375,919 | B2 | 2/2013 | Cook et al. |
| 8,408,023 | B2 | 4/2013 | Shin et al. |
| 8,413,619 | B2 | 4/2013 | Cleeves |
| 8,424,334 | B2 | 4/2013 | Kang et al. |
| 8,429,926 | B2 | 4/2013 | Shaha et al. |
| 8,474,279 | B2 | 7/2013 | Besore et al. |
| 8,516,835 | B2 | 8/2013 | Holter |
| 8,516,846 | B2 | 8/2013 | Lee et al. |
| 8,555,658 | B2 | 10/2013 | Kim et al. |
| 8,616,018 | B2 | 12/2013 | Jeong et al. |
| 8,646,283 | B2 | 2/2014 | Kuratani et al. |
| 8,677,774 | B2 | 3/2014 | Yamaguchi et al. |
| 8,746,204 | B2 | 6/2014 | Hofbauer |
| 8,756,952 | B2 | 6/2014 | Adamski et al. |
| 8,769,981 | B2 | 7/2014 | Hong et al. |
| 8,820,108 | B2 | 9/2014 | Oh et al. |
| 8,925,335 | B2 | 1/2015 | Gooden et al. |
| 8,943,852 | B2 | 2/2015 | Lee et al. |
| 9,127,873 | B2 | 9/2015 | Tarr et al. |
| 9,217,595 | B2 | 12/2015 | Kim et al. |
| 9,217,596 | B2 | 12/2015 | Hall |
| 9,476,631 | B2 | 10/2016 | Park et al. |
| 2002/0014087 | A1 | 2/2002 | Kwon |
| 2003/0111028 | A1 | 6/2003 | Hallenstvedt |
| 2004/0099004 | A1 | 5/2004 | Somura |
| 2004/0144100 | A1 | 7/2004 | Hwang |
| 2004/0206250 | A1 | 10/2004 | Kondou et al. |
| 2004/0237566 | A1 | 12/2004 | Hwang |
| 2004/0261427 | A1 | 12/2004 | Tsuchikawa et al. |
| 2005/0067406 | A1 | 3/2005 | Rajarajan et al. |
| 2005/0126185 | A1 | 6/2005 | Joshi |
| 2005/0126202 | A1 | 6/2005 | Shoukyuu et al. |
| 2005/0151050 | A1 | 7/2005 | Godfrey |
| 2005/0160741 | A1 | 7/2005 | Park |
| 2005/0160757 | A1 | 7/2005 | Choi et al. |
| 2006/0016209 | A1 | 1/2006 | Cole et al. |
| 2006/0032262 | A1 | 2/2006 | Seo et al. |
| 2006/0053805 | A1 | 3/2006 | Flinner et al. |
| 2006/0086107 | A1 | 4/2006 | Voglewede et al. |
| 2006/0086134 | A1 | 4/2006 | Voglewede et al. |
| 2006/0150645 | A1 | 7/2006 | Leaver |
| 2006/0168983 | A1 | 8/2006 | Tatsui et al. |
| 2006/0207282 | A1 | 9/2006 | Visin et al. |
| 2006/0225457 | A1 | 10/2006 | Hallin |
| 2006/0233925 | A1 | 10/2006 | Kawamura |
| 2006/0242971 | A1 | 11/2006 | Cole et al. |
| 2006/0288726 | A1 | 12/2006 | Mori et al. |
| 2007/0028866 | A1 | 2/2007 | Lindsay |
| 2007/0107447 | A1 | 5/2007 | Langlotz |
| 2007/0119202 | A1 | 5/2007 | Kadowaki et al. |
| 2007/0130983 | A1 | 6/2007 | Broadbent et al. |
| 2007/0137241 | A1 | 6/2007 | Lee et al. |
| 2007/0193278 | A1 | 8/2007 | Polacek et al. |
| 2007/0227162 | A1 | 10/2007 | Wang |
| 2007/0227164 | A1 | 10/2007 | Ito et al. |
| 2007/0262230 | A1 | 11/2007 | McDermott |
| 2008/0034780 | A1 | 2/2008 | Lim et al. |
| 2008/0104991 | A1 | 5/2008 | Hoehne et al. |
| 2008/0145631 | A1 | 6/2008 | Bhate et al. |
| 2008/0236187 | A1 | 10/2008 | Kim |
| 2008/0264082 | A1 | 10/2008 | Tikhonov et al. |
| 2009/0049858 | A1 | 2/2009 | Lee et al. |
| 2009/0120306 | A1 | 5/2009 | DeCarlo et al. |
| 2009/0165492 | A1 | 7/2009 | Wilson et al. |
| 2009/0173089 | A1 | 7/2009 | LeClear et al. |
| 2009/0178430 | A1 | 7/2009 | Jendrusch et al. |
| 2009/0187280 | A1 | 7/2009 | Hsu et al. |
| 2009/0199569 | A1 | 8/2009 | Petrenko |
| 2009/0211266 | A1 | 8/2009 | Kim et al. |
| 2009/0211271 | A1 | 8/2009 | Kim et al. |
| 2009/0223230 | A1 | 9/2009 | Kim et al. |
| 2009/0235674 | A1 | 9/2009 | Kern et al. |
| 2009/0272259 | A1 | 11/2009 | Cook et al. |
| 2009/0308085 | A1 | 12/2009 | DeVos |
| 2010/0011827 | A1 | 1/2010 | Stoeger et al. |
| 2010/0018226 | A1 | 1/2010 | Kim et al. |
| 2010/0031675 | A1 | 2/2010 | Kim et al. |
| 2010/0043455 | A1 | 2/2010 | Kuehl et al. |
| 2010/0050663 | A1 | 3/2010 | Venkatakrishnan et al. |
| 2010/0050680 | A1 | 3/2010 | Venkatakrishnan et al. |
| 2010/0055223 | A1 | 3/2010 | Kondou et al. |
| 2010/0095692 | A1 | 4/2010 | Jendrusch et al. |
| 2010/0101254 | A1 | 4/2010 | Besore et al. |
| 2010/0126185 | A1 | 5/2010 | Cho et al. |
| 2010/0139295 | A1 | 6/2010 | Zuccolo et al. |
| 2010/0163707 | A1 | 7/2010 | Kim |
| 2010/0180608 | A1 | 7/2010 | Shaha et al. |
| 2010/0197849 | A1 | 8/2010 | Momose et al. |
| 2010/0218518 | A1 | 9/2010 | Ducharme et al. |
| 2010/0218540 | A1 | 9/2010 | McCollough et al. |
| 2010/0218542 | A1 | 9/2010 | McCollough et al. |
| 2010/0251730 | A1 | 10/2010 | Whillock, Sr. |
| 2010/0257888 | A1 | 10/2010 | Kang et al. |
| 2010/0293969 | A1 | 11/2010 | Braithwaite et al. |
| 2010/0313594 | A1 | 12/2010 | Lee et al. |
| 2010/0319367 | A1 | 12/2010 | Kim et al. |
| 2010/0326093 | A1 | 12/2010 | Watson et al. |
| 2011/0005263 | A1 | 1/2011 | Yamaguchi et al. |
| 2011/0023502 | A1 | 2/2011 | Ito et al. |
| 2011/0062308 | A1 | 3/2011 | Hammond et al. |
| 2011/0146312 | A1 | 6/2011 | Hong et al. |
| 2011/0192175 | A1 | 8/2011 | Kuratani et al. |
| 2011/0214447 | A1 | 9/2011 | Bortoletto et al. |
| 2011/0239686 | A1 | 10/2011 | Zhang et al. |
| 2011/0265498 | A1 | 11/2011 | Hall |
| 2012/0007264 | A1 | 1/2012 | Kondou et al. |
| 2012/0011868 | A1 | 1/2012 | Kim et al. |
| 2012/0023996 | A1 | 2/2012 | Herrera et al. |
| 2012/0047918 | A1 | 3/2012 | Herrera et al. |
| 2012/0073538 | A1 | 3/2012 | Hofbauer |
| 2012/0085302 | A1 | 4/2012 | Cleeves |

(56) References Cited

U.S. PATENT DOCUMENTS

| | | | |
|---|---|---|---|
| 2012/0174613 | A1 | 7/2012 | Park et al. |
| 2012/0240613 | A1 | 9/2012 | Saito et al. |
| 2012/0291473 | A1 | 11/2012 | Krause et al. |
| 2016/0370078 | A1 | 12/2016 | Koo |
| 2017/0074527 | A1 | 3/2017 | Visin |
| 2017/0191722 | A1 | 7/2017 | Bertolini et al. |
| 2017/0314841 | A1 | 11/2017 | Koo et al. |

FOREIGN PATENT DOCUMENTS

| | | | |
|---|---|---|---|
| CN | 102353193 | A | 9/2011 |
| DE | 202006012499 | U1 | 10/2006 |
| DE | 102008042910 | A1 | 4/2010 |
| DE | 102009046030 | | 4/2011 |
| EP | 1653171 | | 5/2006 |
| EP | 1821051 | A1 | 8/2007 |
| EP | 2078907 | A2 | 7/2009 |
| EP | 2444761 | A2 | 4/2012 |
| EP | 2660541 | | 11/2013 |
| EP | 2743608 | A2 | 6/2014 |
| FR | 2771159 | A1 | 5/1999 |
| GB | 657353 | A | 9/1951 |
| GB | 2139337 | A | 11/1984 |
| JP | S60141239 | A | 7/1985 |
| JP | S6171877 | U | 5/1986 |
| JP | 6435375 | | 3/1989 |
| JP | H01196478 | A | 8/1989 |
| JP | H01210778 | A | 8/1989 |
| JP | 1310277 | A | 12/1989 |
| JP | H01310277 | A | 12/1989 |
| JP | H024185 | A | 1/1990 |
| JP | H0231649 | A | 2/1990 |
| JP | H02143070 | A | 6/1990 |
| JP | H03158670 | A | 7/1991 |
| JP | H03158673 | A | 7/1991 |
| JP | H0415069 | A | 1/1992 |
| JP | H04161774 | A | 6/1992 |
| JP | H4260764 | A | 9/1992 |
| JP | H051870 | A | 1/1993 |
| JP | H05248746 | A | 9/1993 |
| JP | H05332562 | A | 12/1993 |
| JP | H063005 | A | 1/1994 |
| JP | H0611219 | A | 1/1994 |
| JP | H06323704 | A | 11/1994 |
| JP | H10227547 | A | 8/1998 |
| JP | H10253212 | A | 9/1998 |
| JP | H11223434 | A | 8/1999 |
| JP | 2000039240 | A | 2/2000 |
| JP | 2000346506 | A | 12/2000 |
| JP | 2001041620 | A | 2/2001 |
| JP | 2001041624 | A | 2/2001 |
| JP | 2001221545 | A | 8/2001 |
| JP | 2001355946 | | 12/2001 |
| JP | 2002139268 | A | 5/2002 |
| JP | 2002295934 | A | 10/2002 |
| JP | 2002350019 | A | 12/2002 |
| JP | 2003042612 | A | 2/2003 |
| JP | 2003042621 | A | 2/2003 |
| JP | 2003172564 | A | 6/2003 |
| JP | 2003232587 | A | 8/2003 |
| JP | 2003269830 | A | 9/2003 |
| JP | 2003279214 | A | 10/2003 |
| JP | 2003336947 | A | 11/2003 |
| JP | 2004053036 | A | 2/2004 |
| JP | 2004278894 | A | 10/2004 |
| JP | 2004278990 | A | 10/2004 |
| JP | 2005164145 | A | 6/2005 |
| JP | 2005180825 | A | 7/2005 |
| JP | 2005195315 | A | 7/2005 |
| JP | 2006022980 | A | 1/2006 |
| JP | 2006071247 | A | 3/2006 |
| JP | 2006323704 | A | 11/2006 |
| JP | 2007232336 | A | 9/2007 |
| JP | 4333202 | B2 | 9/2009 |
| KR | 20010109256 | A | 12/2001 |
| KR | 20060013721 | A | 2/2006 |
| KR | 20060126156 | A | 12/2006 |
| KR | 100845860 | B1 | 7/2008 |
| KR | 20100123089 | A | 11/2010 |
| KR | 20110037609 | A | 4/2011 |
| SU | 1747821 | A1 | 7/1992 |
| TW | 424878 | U | 3/2001 |
| WO | 8808946 | A1 | 11/1988 |
| WO | 2008052736 | A1 | 5/2008 |
| WO | 2008056957 | A2 | 5/2008 |
| WO | 2008061179 | A2 | 5/2008 |
| WO | 2008143451 | A1 | 11/2008 |

OTHER PUBLICATIONS

European Search Report dated Mar. 10, 2015, U.S. Pat. No. 2,784,415; pp. 1-6.

European Search Report dated Mar. 10, 2015, U.S. Pat. No. 2,784,416; pp. 1-7.

European Searching Authority, European Search Report and Opinion for Application No. EP13194691.5, dated Mar. 10, 2015; pp. 1-7.

European Searching Authority, European Search Report and Opinion for Application No. EP13194682.4, dated Jul. 15, 2015, 12 pages.

Merriam-Webster definition of oscillate, http://www.Merriam-Webster.com/dictionary/oscillate, pp. 1-4, accessed from internet Aug. 6, 2015.

European Search Report dated Nov. 7, 2016, Application No. 13194679.0; 10 pages.

"Manufacturing Processes—Explosive Sheetmetal Forming," Engineer's Handbook, 2006, web archive, last accessed Jan. 19, 2016, at http://www.engineershandbook.com/MfgMethods/exforming.htm, pp. 1-3.

"Nickel Alloys for Electronics," A Nickel Development Institute Reference Book, 1988, 131 pages, Series N 11 002, NiDI Nickel Development Institute.

Daehn, "High-Velocity Metal Forming," ASM Handbook, 2006, pp. 405-418, vol. 148, ASM International.

Daehn, et al., "Hyperplacstic Forming: Process Potential and Factors Affecting Formability," MRS Proceedings, 1999, at p. 147, vol. 601.

Jimbert et al., "Flanging and Hemming of Auto Body Panels using the Electro Magnetic Forming technology," 3rd International Conference on High Speed Forming, 2008, pp. 163-172.

Shang et al., "Electromagnetically assisted sheet metal stamping," Journal of Materials Processing Technology, 2010, pp. 868-874, 211.

* cited by examiner

MULTI-SHEET SPHERICAL ICE MAKING

CROSS-REFERENCE TO RELATED APPLICATIONS

This application is a divisional application that claims priority to and the benefit under 35 U.S.C. § 120 of U.S. patent application Ser. No. 13/713,160, filed on Dec. 13, 2012, entitled "MULTI-SHEET SPHERICAL ICE MAKING," now U.S. Pat. No. 9,518,770, the entire disclosure of which is hereby incorporated by reference in its entirety.

FIELD OF THE INVENTION

The present invention generally relates to an ice maker adapted to form a unitary sheet of ice for molding into ice structures, and more specifically, to an ice maker adapted to provide a plurality of clear ice sheets which can be fused into a unitary ice sheet to form clear ice structures therefrom.

BACKGROUND OF THE INVENTION

In making ice structures for use by consumers, for example, for cooling a beverage, the ice structures may be clear ice structures molded from a clear ice block. In order to form clear ice structures from a clear ice block, the clear ice block must be formed having a certain predetermined thickness that provides for enough ice material to mold clear ice structures of a desired shape. In forming the clear ice block, layers of running water may be frozen on a cold plate in a single operation until the layers have formed a clear ice block having the required thickness to form the desired clear ice structures. It has been found that forming a clear ice block, having a necessary thickness to form clear ice structures, in a single operation takes a prolonged period of time, particularly as the water-ice freezing surface of the ice block develops further and further away from the cooling source. Thus, a more efficient method of producing a clear ice block having a sufficient thickness to mold ice structures therefrom is desired.

The present invention provides for efficiently made clear ice sheets which are fused together to form a unitary clear ice block having the desired thickness necessary for molding clear ice structures of particular shape.

SUMMARY OF THE PRESENT INVENTION

According to one aspect of the present invention, an ice maker is disclosed. The ice maker includes an evaporator plate having a first side and a second side. The first side of the evaporator plate is adapted to form a first clear ice sheet and the second side of the evaporator plate is adapted to form a second clear ice sheet. A staging apparatus is arranged downstream from the evaporator plate and is adapted to receive the first and second clear ice sheets after formation. The first and second clear ice sheets are fused in the staging apparatus to form a unitary clear ice sheet. A first mold form and a second mold form are positioned within the staging apparatus on opposite sides of the unitary clear ice sheet when the unitary ice sheet is received in the staging apparatus. A mold cavity is defined by the first and second mold forms and is adapted to shape the unitary clear ice sheet to form one or more clear ice structures.

According to another aspect of the present invention, an ice maker is disclosed. The ice maker includes an evaporator plate having a first side and a second side configured to form first and second ice sheets thereon. A water supply is configured to run water over the first and second sides of the evaporator plate creating first and second ice sheets. A staging apparatus is configured to position the contoured surfaces of the first and second ice sheets in alignment with one another. A mold apparatus includes a first mold assembly and a second mold assembly. Each mold assembly includes one or more mold forms that align to form mold cavities when the mold apparatus is in a closed position such that the mold apparatus presses the first and second ice sheets towards one another to form one or more individual ice structures.

According to another aspect of the present invention, an ice maker is disclosed. The ice maker includes an evaporator plate having a first side and a second side configured to form first and second ice sheets thereon. First and second planar surfaces are respectively disposed on the first and second sides of the evaporator plate. First and second contoured surfaces are respectively disposed above the first and second planar surfaces. Third and fourth contoured surfaces are respectively disposed on opposing sides of the first and second planar surfaces from the first and second contoured surfaces.

These and other aspects, objects, and features of the present invention will be understood and appreciated by those skilled in the art upon studying the following specification, claims, and appended drawings.

DETAILED DESCRIPTION OF EMBODIMENTS

Figure 1:
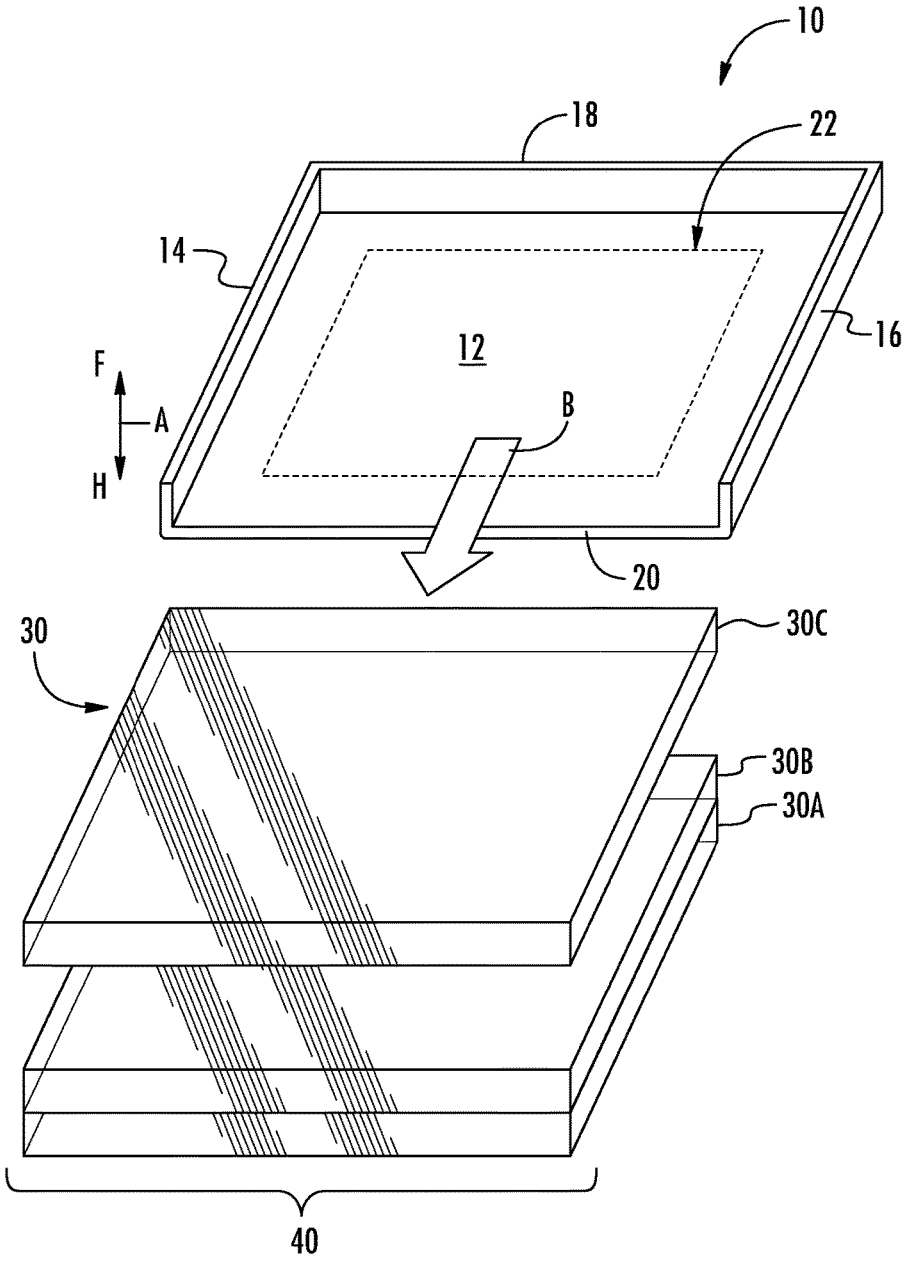
FIG. 1 is a perspective view of a cold plate apparatus depositing a plurality of ice sheets.

For purposes of description herein, the terms "upper," "lower," "right," "left," "rear," "front," "vertical," "horizontal," and derivatives thereof shall relate to the invention as oriented in FIG. 1. However, it is to be understood that the invention may assume various alternative orientations, except where expressly specified to the contrary. It is also to be understood that the specific devices and processes illustrated in the attached drawings, and described in the following specification are simply exemplary embodiments of the inventive concepts defined in the appended claims. Hence, specific dimensions and other physical characteristics relating to the embodiments disclosed herein are not to be considered as limiting, unless the claims expressly state otherwise.

Referring to FIG. 1, the reference numeral 10 generally designates a cold plate apparatus which is adapted to freeze running water supplied from a cold water supply. As shown in FIG. 1, the cold plate apparatus 10 generally comprises a plate surface 12 having side walls 14, 16, a rear wall 18 and an open front end 20. The cold plate apparatus is in thermal communication with a cooling source 22 indicated by the dashed lines on the plate surface 12 of the cold plate apparatus 10. The cooling source 22 can take several different forms, such as an evaporator plate, or thermoelectric plate, a heat sink or heat exchanger in thermal communication with the cold plate apparatus 10 as indicated by the dashed lines in FIG. 1. The cooling source 22 may also include a cooling loop or a cool air supply wherein cool air, that is below freezing temperature, is provided about the cold plate apparatus 10 in adequate supply so as to freeze a portion of running water into layers on the cold plate surface 12. A variety of cooling sources are available for use with the present invention, so long as the cooling source is in thermal communication with the cold plate apparatus 10 and is configured to provide sufficient cooling to freeze running water deposited on the cold plate apparatus 10 as further described below. As shown in FIG. 1, the cold plate apparatus 10 is in an ice harvesting position "H" and is further adapted to be moveable from the ice harvesting position H to an ice formation position "F" in a direction indicated by arrow A. In the ice harvesting position H, the cold plate apparatus 10 is adapted to deposit formed clear ice sheets 30 into a staging apparatus 40 from the plate surface 12 of the cold plate apparatus 10. The ice sheets 30 are generally gravitationally deposited from the cold plate apparatus 10 over the open front side 20 of the cold plate apparatus 10 in a direction indicated by arrow B into the downstream staging apparatus 40. As shown in FIG. 1, clear ice sheets 30A, 30B and 30C have been formed on the cold plate apparatus 10 and clear ice sheets 30A and 30B have been stacked in the staging apparatus with clear ice sheet 30C in transition from the cold plate apparatus 10 to the staging apparatus 40. To facilitate clean bonding between ice sheets, the ice sheets are created relatively flat. The flat nature of the ice sheets helps to reduce visual flaws at the plane of fusion between ice sheets. Further, it is contemplated that after formation, the ice sheets can be run across a heated metal plate to help create flat surfaces before fusion.

Figure 1A:
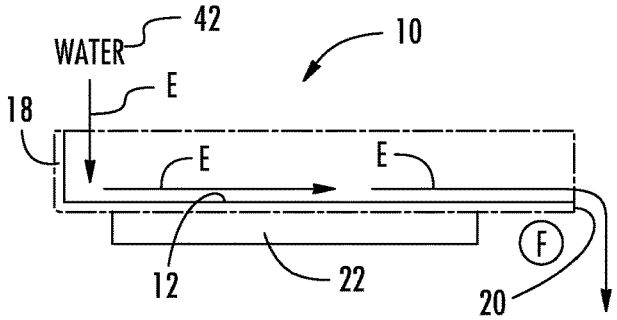
FIGS. 1A-1D are side elevational views of a cold plate apparatus forming an ice sheet by freezing running water into layers.
Figure 1B:
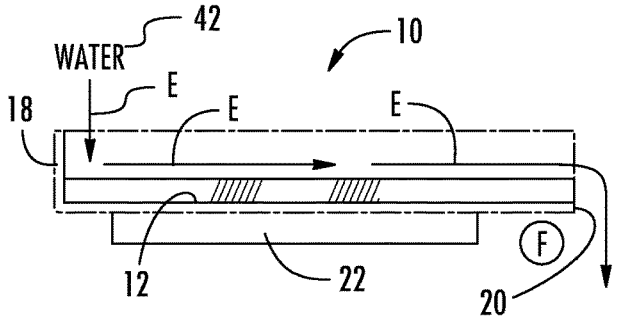
Figure 1C:
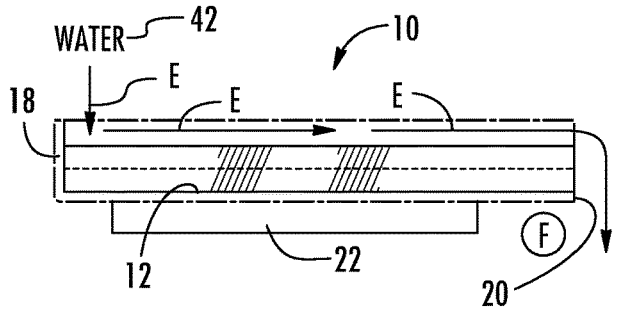
Figure 1D:
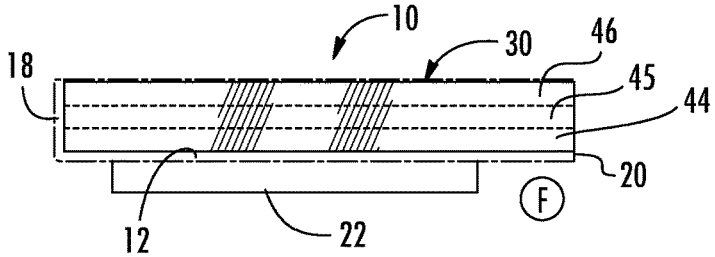
Figure 1E:
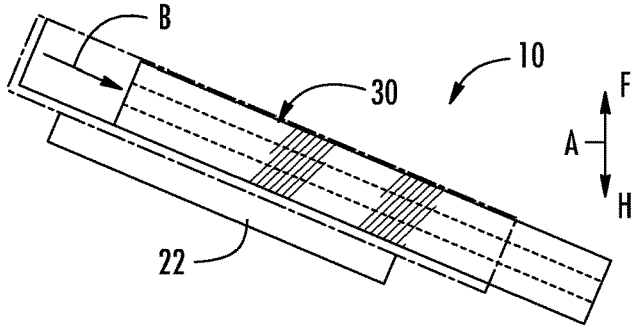
FIG. 1E is a side elevation view of the cold plate apparatus of FIG. 1A depositing an ice sheet.

As shown in FIGS. 1A-1C, running water is shown being deposited from a water supply 42 onto a cold plate apparatus 10. The running water emits from the water supply 42 while the cold plate apparatus 10 is in the ice formation position F. The running water runs over the plate surface 12 of the cold plate apparatus 10 in a direction indicated by arrows E. The running of water over the cold plate surface 12 of the cold plate apparatus 10 results in the formation of ice layers, such as ice layers 44, 45 and 46 identified in FIGS. 1B-1D. The ice formation, or the freezing of a portion of the running water into layers, is caused by the thermal communication between the cooling source 22 and the cold plate apparatus 10. With running water continuously moving over the plate surface 12 of the cold plate apparatus 10, the layers of ice formed (44-46), are clear ice layers which are free from air and other mineral deposits. The multiple layers of ice (44-46) are formed efficiently as they are in close proximity to the cold plate apparatus during the freezing process. Together, the multiple layers (44-46) combine to form a single clear ice sheet 30 of a desired thickness. As shown in FIG. 1E, the cold plate apparatus 10 will move to the ice harvesting position H when an ice sheet 30 has been developed to a desired predetermined thickness. By moving to the ice harvesting position H, the cold plate apparatus 10 acts as a depositing mechanism which deposits the formed ice sheet 30 into a staging apparatus, such as staging apparatus 40 shown in FIG. 1, along a direction as indicated by arrow B. As noted above, the individual ice sheets 30, produced by the freezing of running water over the cold plate apparatus 10, are comprised of individual ice layers, such as ice layers 44-46. The cold plate apparatus 10 of the present invention is configured to produce a plurality of ice sheets, such as ice sheets 30A, 30B and 30C as shown in FIG. 1, in succession. Each of these individual clear ice sheets 30A, 30B and 30C are comprised of any number of frozen clear ice layers necessary to produce the desired thickness of the ultimate clear ice sheet 30 formed. As demonstrated in FIGS. 1A-1E, the running water is allowed to gradually freeze over the cold plate apparatus 10 until an ice maker, in which the cold plate apparatus 10 is disposed, determines that an ice sheet of an appropriate thickness has been formed on the cold plate apparatus 10 and should be deposited in a downstream staging apparatus. As used throughout this disclosure, the term "downstream" refers to a component of the present invention that is disposed further along in an ice making process than a referenced component. The term "downstream" does not necessarily require that the component being coined a "downstream component" be somehow disposed below or underneath a referenced component.

Figure 2:
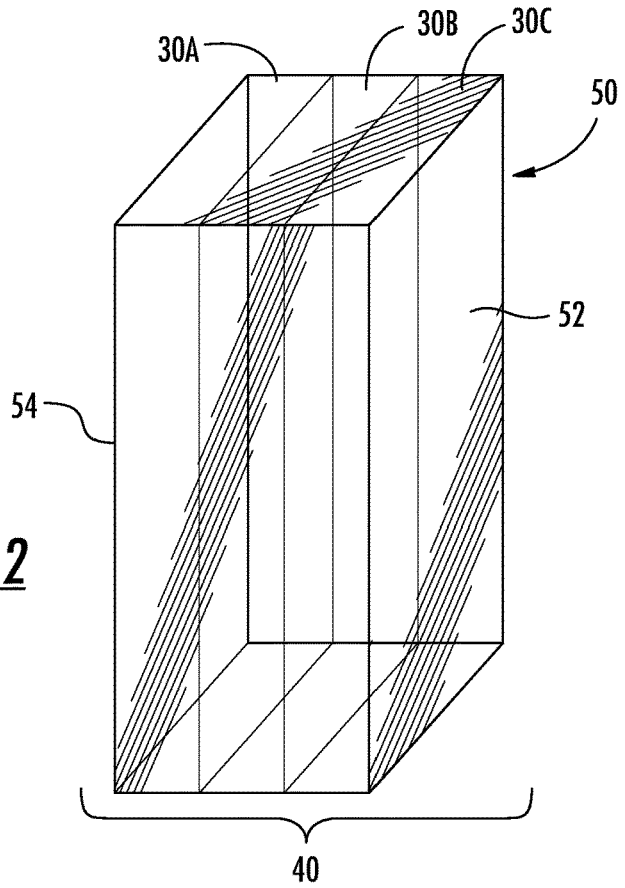
FIG. 2 is a perspective view of a unitary ice sheet formed from a plurality of ice sheets fused together in a generally vertical orientation.
Figure 2A:
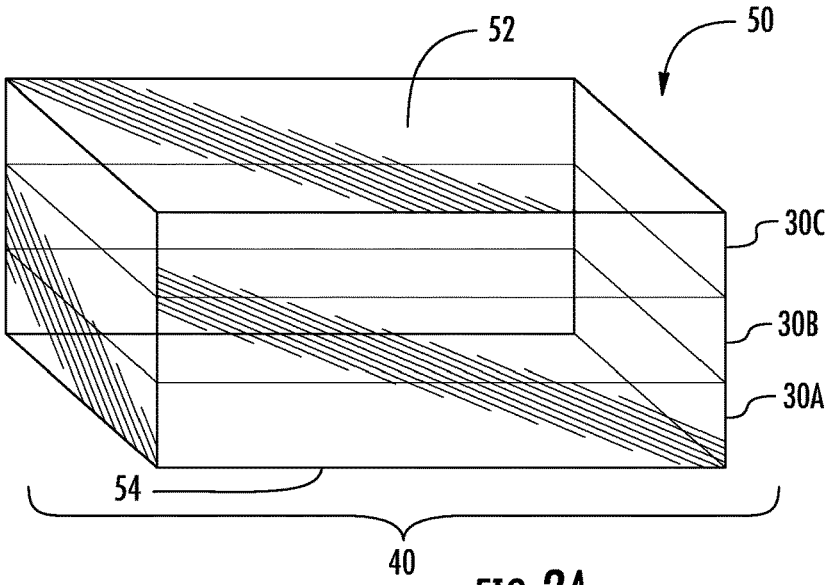
FIG. 2A is a perspective view of a unitary ice sheet formed from a plurality of ice sheets fused together in a generally horizontal orientation.

Referring now to FIGS. 2 and 2A, a plurality of ice sheets 30 are shown and identified as ice sheets 30A, 30B and 30C disposed in a staging apparatus 40. With specific reference to FIG. 2, the ice sheets 30A, 30B and 30C are fused together in a vertical orientation to produce a unitary clear ice sheet 50. The staging apparatus 40 is adapted to receive, orient and fuse the plurality of ice sheets 30A, 30B and 30C to form the unitary ice sheet 50. The unitary ice sheet 50, shown in FIGS. 2 and 2A, is a clear unitary ice sheet having a first surface 52 and a second surface 54. As shown in FIG. 2A, the unitary clear ice sheet 50 is comprised of fused clear ice sheets 30A, 30B and 30C disposed in a generally horizontal manner in the staging apparatus 40. It is noted that the staging apparatus is generally kept below a freezing temperature, such that as wet ice sheets 30 are deposited from the cold plate apparatus 10 into the staging apparatus 40, the ice sheets 30 will freeze together or fuse to form a unitary clear ice sheet, such as unitary clear ice sheet 50 shown in FIGS. 2 and 2A. In this way, the present invention provides the ability to make a thicker clear ice sheet for molding in a shorter period of time by seamlessly fusing multiple ice slabs or sheets into a unitary whole.

Thus, with reference to FIGS. 1-2A, a cold plate apparatus 10 can produce a plurality of ice sheets, such as ice sheets 30A, 30B and 30C. Together the ice sheets 30A, 30B and 30C can be fused into a unitary ice sheet 50 having a desired thickness to use in a molding apparatus to form individual ice structures. In the past, an ice sheet would normally have been provided on a cold plate apparatus by freezing running water over the cold plate apparatus until an ice sheet, having a thickness similar to the thickness of unitary ice sheet 50, had been formed. However, such a formation process can be time consuming and inefficient as the rate to freeze ice slows down as the ice develops and gets thicker on a cold plate apparatus. This is generally due to the increased distance between the cold plate and the water-ice interface on a developing ice sheet. By individually forming and fusing several different clear ice sheets together, a unitary ice sheet, such as unitary ice sheet 50, can be formed from separate clear ice sheets which can be more efficiently developed on a cold plate as a relative distance between the cold plate and the water-ice interface is minimized with the individual ice sheets as compared to a fully formed ice block. Thus, the present invention is much more efficient as compared to the development of a single clear ice block on a cold plate apparatus that creates an undesirable distance between the cold plate and the water-ice freezing surface.

Figure 3:
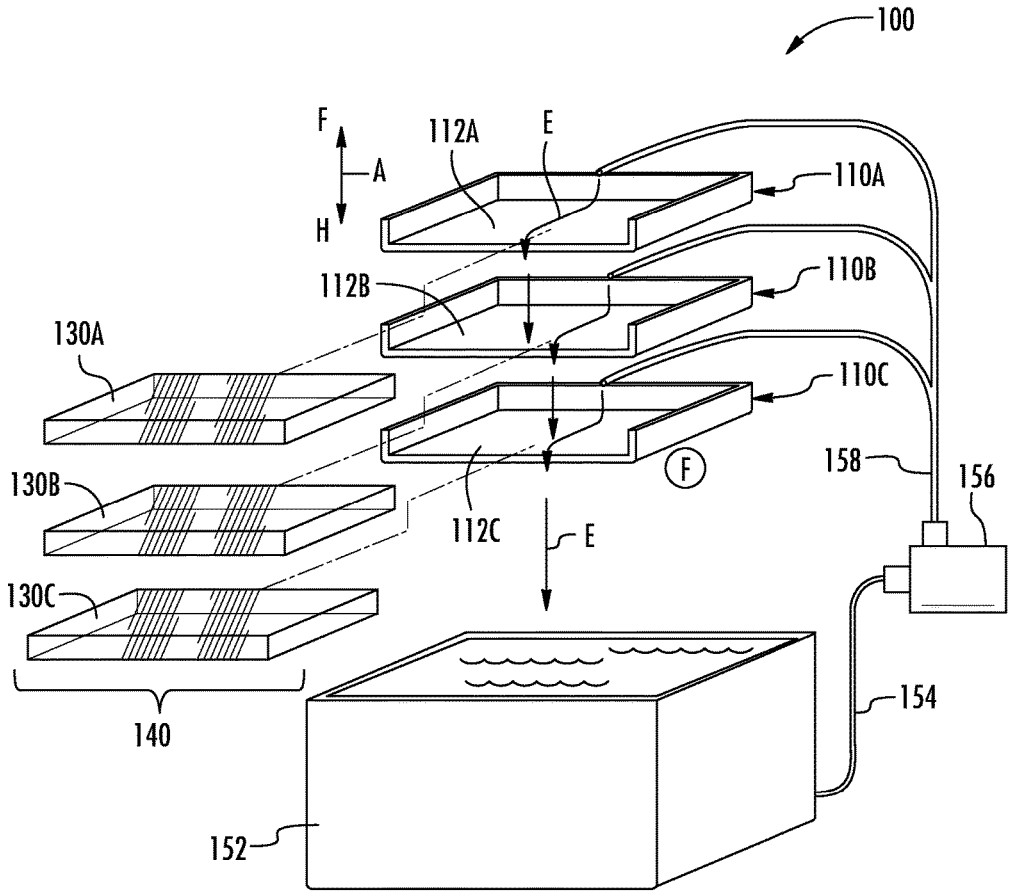
FIG. 3 is a perspective view of a cold plate apparatus having a plurality of cold plates and a plurality of ice sheets.

Referring now to FIG. 3, the reference numeral 100 generally designates a cold plate apparatus having a plurality of cold plates 110A, 110B and 110C associated with the cold plate apparatus 100. Each of the associated cold plates 110A, 110B and 110C are adapted to freeze running water, indicated by arrows E, to form a clear ice sheet made up of layers of frozen water in a manner as described above. In this way, the cold plate apparatus 100 is adapted to provide a plurality of clear ice sheets indicated in FIG. 3 as clear ice sheets 130A, 130B and 130C. The cold plate apparatus 100 is adapted to form the clear ice sheets 130A, 130B and 130C simultaneously. The associated cold plates 110A, 110B and 110C are generally configured in a similar manner as cold plate 10 described above with reference to FIG. 1. As such, it is contemplated that the associated cold plates 110A, 110B and 110C are in thermal communication with a cooling source adapted to provide cooling to the running water as deposited over a plate surface 112A, 112B and 112C associated with each cold plate 110A, 110B and 110C, respectively.

Figure 4:
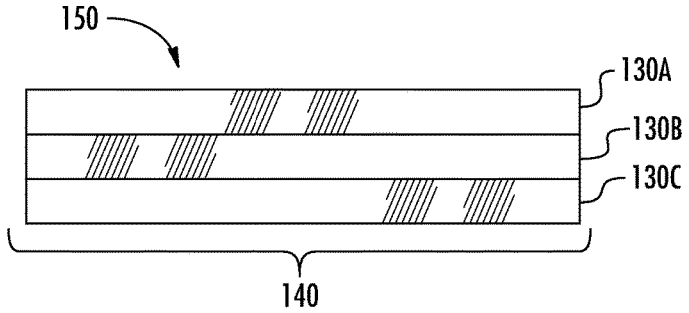
FIG. 4 is a side elevational view of a unitary ice sheet formed from a plurality of ice sheets fused together in a staging apparatus.

Once clear ice sheets 130 are simultaneously formed on each associated cold plate apparatus 110A, 110B, and 110C to a predetermined thickness, the clear ice sheets 130A, 130B and 130C are deposited into a staging apparatus 140. In the staging apparatus 140, the clear ice sheets 130A, 130B, and 130C are fused together to form a unitary clear ice sheet 150 as shown in FIG. 4. A water reservoir apparatus 152 is shown in FIG. 3 and is adapted to collect running water which is not frozen on the associated cold plates 110A, 110B and 110C during the ice formation stage. The water reservoir apparatus 152 thereby collects the running water which can be used again in the ice formation process by pumping the water from the water reservoir apparatus 152 through a fluid conduit 154 to a pump 156 which feeds running water to the associated cold plates 110A, 110B and 110C through water supply lines 158. As shown in FIG. 3, the associated cold plates 110A, 110B and 110C are in an ice formation position F and are capable of moving to an ice harvesting position H along a direction indicated by arrow A. In the ice harvesting position H, the associated cold plates 110A, 110B and 110C will deposit the formed ice sheets 130A, 130B and 130C to the staging apparatus 140 where they will be fused into a unitary ice sheet 150 as shown in FIG. 4. In this way, the embodiment of a cold plate apparatus shown in FIG. 3 is capable of simultaneously producing a plurality of clear ice sheets for fusing into a unitary clear ice sheet. By using multiple clear ice sheets which are simultaneously formed, the cold plate apparatus 100 of the embodiment shown in FIG. 3 is capable of producing a unitary ice sheet 150 in a manner much more efficiently than the production of a single clear ice sheet having a necessary thickness to form clear ice structures therefrom. The efficiency of this embodiment of the present invention is generally realized by the simultaneous creation of multiple clear ice sheets for fusion into a unitary clear ice sheet.

Figure 5:
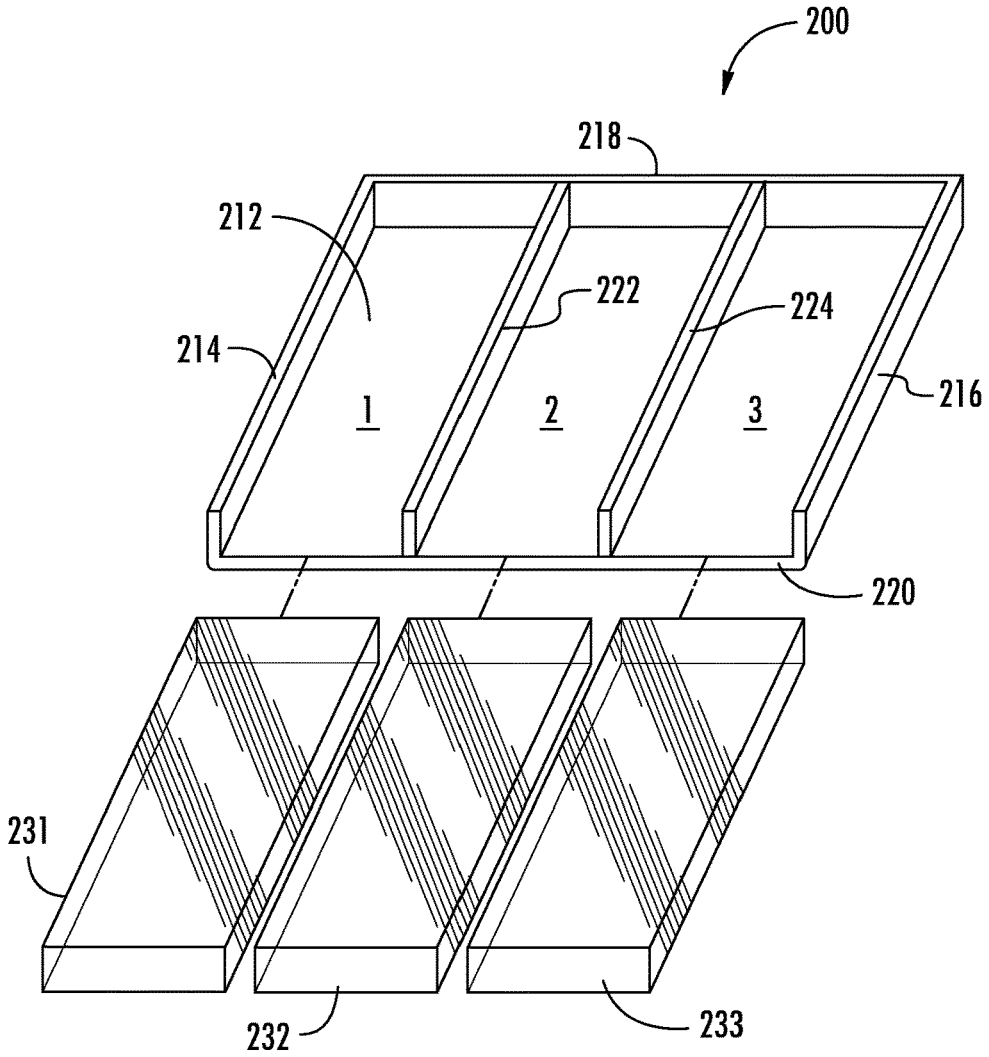
FIG. 5 is a perspective view of a cold plate apparatus having mechanical dividers and a plurality of ice sheets being deposited from the cold plate apparatus.
Figure 6:
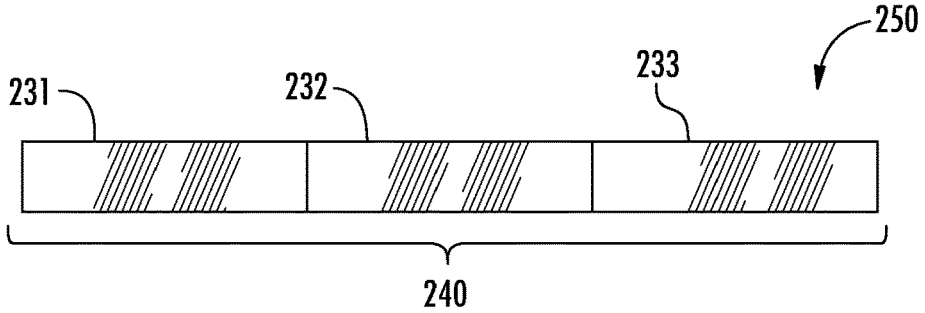
FIG. 6 is a side elevational view of a plurality of ice sheets in a staging apparatus.

Referring now to FIG. 5, a cold plate apparatus 200 is shown having a plate surface 212 with side walls 214, 216, a rear wall 218 and an open front end 220. The cold plate apparatus 200 of FIG. 5 further includes one or more dividers indicated as dividers 222 and 224, which are adapted to mechanically divide the plate surface 212 into sections 1, 2 and 3 as shown in FIG. 5. The cold plate apparatus 200 is adapted to form multiple clear ice sheets in each of the areas 1, 2 and 3 divided along the plate surface 212. Formation of the ice sheets is provided in a manner similar to the ice sheet formation depicted in FIGS. 1A-1D and described above. As shown in FIG. 5, developed clear ice sheets 231, 232 and 233 are deposited from the divided areas 1, 2 and 3 of the cold plate apparatus 200 into a staging apparatus 240. As shown in FIG. 6, the formed ice sheets 231, 232 and 233 have been fused together in a generally side-by-side manner, however, it is contemplated that the formed ice sheets 231, 232 and 233 can also be fused together in horizontal or vertical orientation as shown in FIGS. 2 and 2A to provide a unitary ice sheet 250 from which ice structures can be formed.

Figure 7:
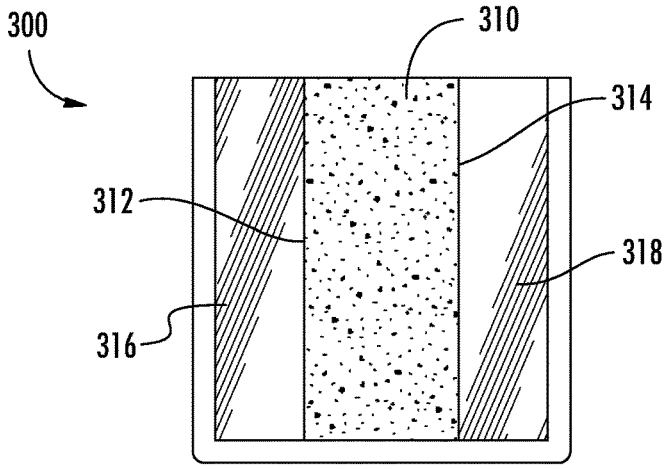
FIG. 7 is a side elevational view of an evaporator plate having a first side and a second side with a clear ice sheet formed on each side.
Figure 7A:
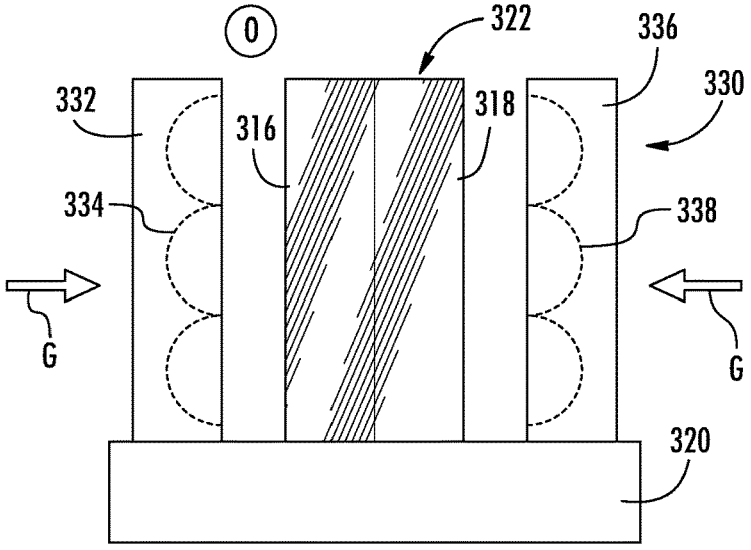
FIG. 7A is a side elevational view of a unitary ice sheet disposed between first and second mold halves of a mold apparatus.
Figure 7B:
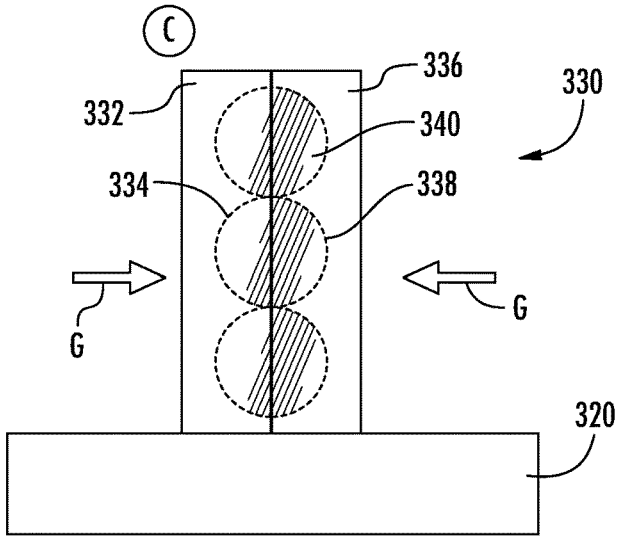
FIG. 7B is a side elevational view of the first and second mold halves of FIG. 7A being closed about the unitary ice sheet.

Referring now to FIGS. 7-7B, component parts of an ice maker are shown including an evaporator apparatus 300 having an evaporator plate 310 which includes a first side 312 and a second side 314 configured to form first and second ice sheets 316 and 318 thereon. Clear ice sheets are formed on the first and second sides 312, 314 of the evaporator plate 310 by supplying running water over the first and second sides 312, 314 of the vertically oriented evaporator plate 310 until fully developed ice sheets, such as first and second ice sheets 316, 318, are formed having a predetermined thickness. When the first and second ice sheets 316, 318 are fully formed by freezing layers of running water on the evaporator plate 310, the first and second ice sheets 316, 318 are deposited into a staging apparatus 320 where the first and second ice sheets 316, 318 are fused to form a unitary clear ice sheet 322. It is contemplated that after ice sheet formation, a hot gas valve could turn on to warm the evaporator plate. This warming of the evaporator plate would then melt the bond between the ice sheet and the evaporator plate allowing the ice sheet to slide down the incline of the cold plate into the staging apparatus. In assembly, the staging apparatus 320 is disposed downstream from the evaporator apparatus 300 and is adapted to receive the first and second clear ice sheets 316, 318 after formation on the evaporator plate 310 as described above.

Referring now to FIG. 7A, a mold apparatus 330 is disposed in the staging apparatus 320 and includes a first mold assembly 332 having a first mold form 334 and a second mold assembly 336 having a second mold form 338. As shown in FIG. 7A, the first and second mold forms 334, 338 are reciprocal dome-shaped mold forms which are adapted to form a mold cavity as further described below. As shown in FIG. 7A, the unitary ice sheet 322 is disposed in the mold apparatus 330 having the first mold assembly 332 and the second mold assembly 336 positioned on opposite sides thereof. A drive mechanism is coupled to the mold apparatus 330 and is adapted to drive the mold apparatus between an open position "O," FIG. 7A, and a closed position "C," FIG. 7B. As shown in FIG. 7A, the mold apparatus is in an open position, wherein the first and second mold assemblies 332, 336 are spaced apart from one another such that adequate space is provided to receive the fused unitary ice sheet 322. As indicated by arrows G, the drive mechanism is adapted to drive the first and second mold assemblies 332, 336 from the open position O to a closed position C about the unitary ice sheet 322 as shown in FIG. 7B. When the mold apparatus 330 is in the closed position C, the first and second mold assemblies 332, 336 are positioned adjacent one another in an abutting relationship, such that the first and second mold forms 334, 338 align to create a mold cavity 340. In this way, the mold apparatus 330 is adapted to shape or carve the unitary clear ice sheet 322 to form one or more clear ice structures in the mold cavity 340 by driving the first and second mold assemblies 332, 336 to the closed position C about the unitary ice sheet 332. It is further contemplated that the mold apparatus 330 may also include one or more heating elements selectively placed and associated with the first and second mold assemblies 332, 336. In this way, the heated mold apparatus 330 will more proficiently form or shape a unitary ice sheet, such as unitary ice sheet 322 shown in FIG. 7B, as the mold assemblies 332, 336 are closed about the unitary ice sheet.

Figure 7C:
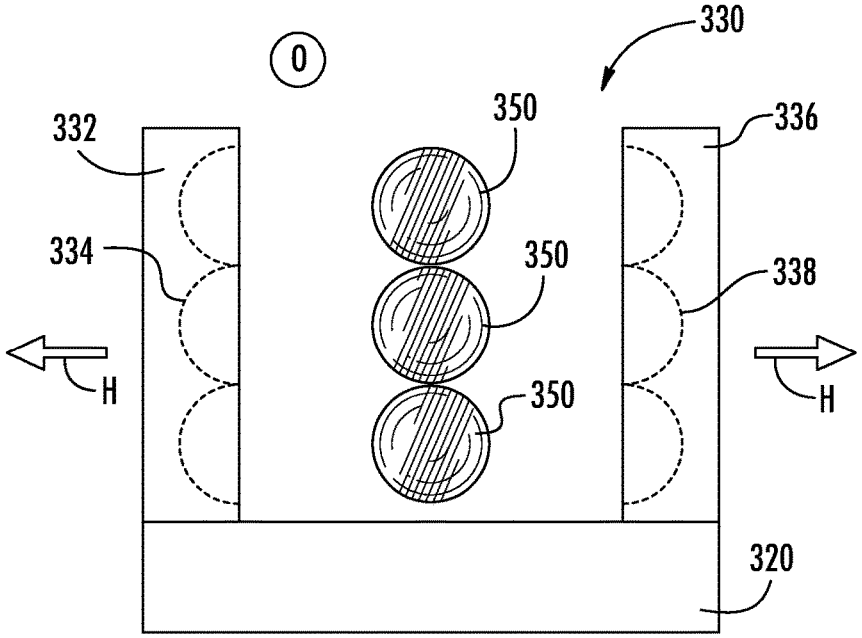
FIG. 7C is a side elevational view of the first and second mold halves of FIG. 7B in an open position and a plurality of clear ice structures.

Referring now to FIG. 7C, the mold apparatus 330 is shown again in the open position O, wherein the drive mechanism has driven the first and second mold assemblies 332, 336 from the closed position C, shown in FIG. 7B, to the open position O, shown in FIG. 7C along a path indicated by arrows H. Clear ice structures 350 have now been formed by the driving of the first and second mold assemblies 332, 336 to the closed position C about the unitary clear ice sheet 322. The clear ice structures 350 are molded clear ice structures formed from the mold forms 334, 338 of the first and second mold assemblies 332, 336. As indicated in the embodiment shown in FIGS. 7A-7C, the mold forms 334, 338 are dome-shaped mold forms adapted to form clear ice spheres 350 by shaping the unitary clear ice sheet 322 using the ice forming process described above. It is contemplated that any number of clear ice spheres 350 can be produced using the mold apparatus 330 and this number is directly controlled by the number of individual molding structures that are defined in the mold cavity 340 when the first and second mold assemblies 332, 336 are assembled in the closed position C. The resulting clear ice spheres are contemplated to have a diameter in a range from about 20 mm-70 mm, and more preferably, 50 mm.

Thus, as shown in FIGS. 7A-7C, the mold apparatus 330 closes about the unitary ice sheet 322 such that the ice sheet 322 is carved, melted or otherwise formed into the corresponding shapes of the mold forms 334, 338 of the first and second mold assemblies 332, 336. Therefore, when the mold apparatus 330 closes about a unitary ice structure 322, this means that the ice structure 322 is placed between the first and second mold assemblies or mold halves 332, 336 and pressed between the mold halves 332, 336 to form the unitary ice sheet 322 into individual clear ice structures 350, as shown in FIG. 7C. Further, it is noted that any unitary ice sheet, such as unitary ice sheets 50, 150 and 250 described above, can be molded in the mold apparatus 330 to make individual clear ice structures.

Figure 8:
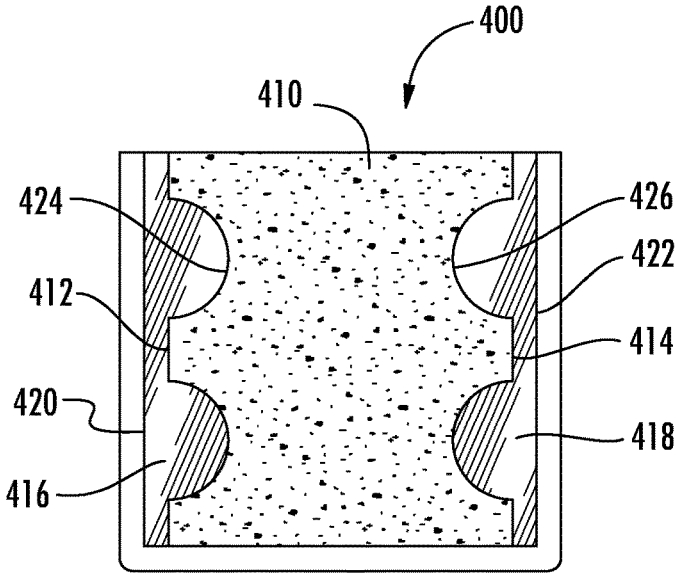
FIG. 8 is a side elevational view of an evaporator plate having a molded first side and a molded second side and a clear ice sheet formed on each side.

Referring now to FIG. 8, an evaporator apparatus 400 is shown with an evaporator plate 410 having a first side 412 and a second side 414 for forming ice sheets thereon. As shown in FIG. 8, the first and second sides 412, 414 of the evaporator plate 410 are molded or contoured surfaces which create ice sheets 416 and 418 having generally planar surfaces 420, 422 and contoured surfaces 424, 426, respectively. The ice sheets 416, 418 are generally formed by running water over the first and second sides 412, 414 of the evaporator plate 410 until the ice sheets 416, 418 are prepared to a desired thickness. The ice sheets 416, 418 are then released from the evaporator plate and then aligned such that the generally planar sides 420, 422 are disposed adjacent one another as the ice sheets 416, 418 are fused in a staging apparatus 428 to form a unitary clear ice structure 430 shown in FIG. 8A.

Figure 8A:
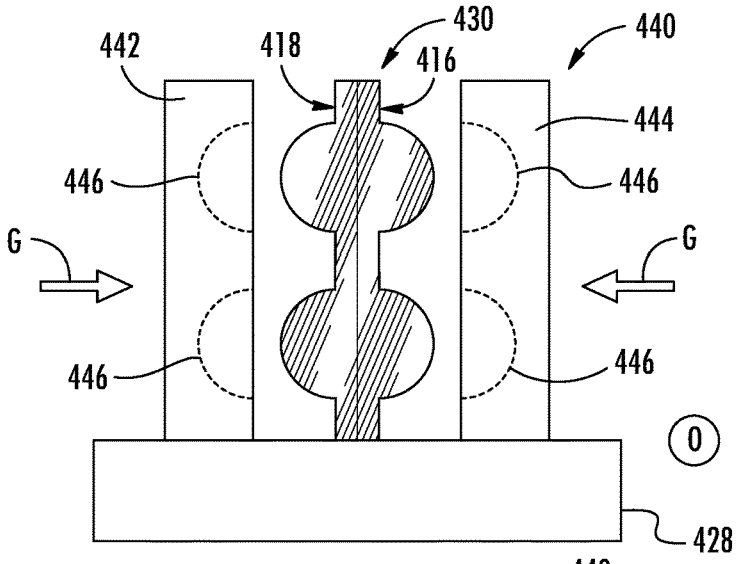
FIG. 8A is a side elevational view of the ice sheets of FIG. 8 disposed between first and second mold halves of a mold apparatus.
Figure 8B:
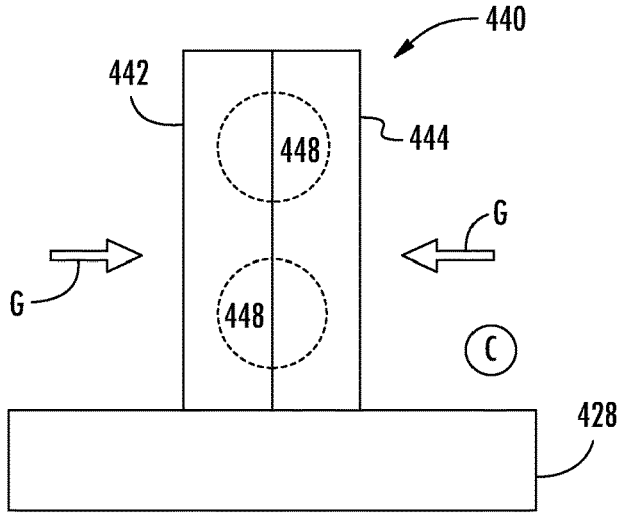
FIG. 8B is a side perspective view of the mold apparatus of FIG. 8A in a closed position about the unitary ice sheet of FIG. 8A.

As shown in FIG. 8A, the ice sheets 416, 418 are positioned in the staging apparatus such that the contoured surfaces 424, 426 of the ice sheets 416, 418 are disposed in alignment with one another. With the ice sheets 416, 418 prepared on an evaporator plate 410 having contoured or molded sides 412, 414, the resulting fused unitary ice sheet 430 already possesses pre-contoured forms when placed in the mold apparatus 440. The contoured form of the unitary ice sheet 430 helps increase the efficiency of creating formed ice structures as the mold apparatus 440 does not have to mold, carve or melt as much stock ice material from the unitary ice sheet 430 relative to a solid block formed unitary ice sheet. As shown in FIG. 8A, the mold apparatus 440 comprises a first mold assembly 442 and a second mold assembly 444. Each mold assembly includes one or more mold forms 446, which align to form mold cavities 448 when the mold apparatus 440 is in the closed position C as shown in FIG. 8B. The mold apparatus 440 moves to the closed position C, as shown in FIG. 8B, by driving the first and second mold assemblies 442, 444 using a drive mechanism in a direction as indicated by arrows G. In the closed position, the first and second mold assemblies 442, 444 abut one another such that the mold apparatus 440 fully closes about the unitary ice sheet 430 to form individual ice structures 450 shown in FIG. 8C.

Figure 8C:
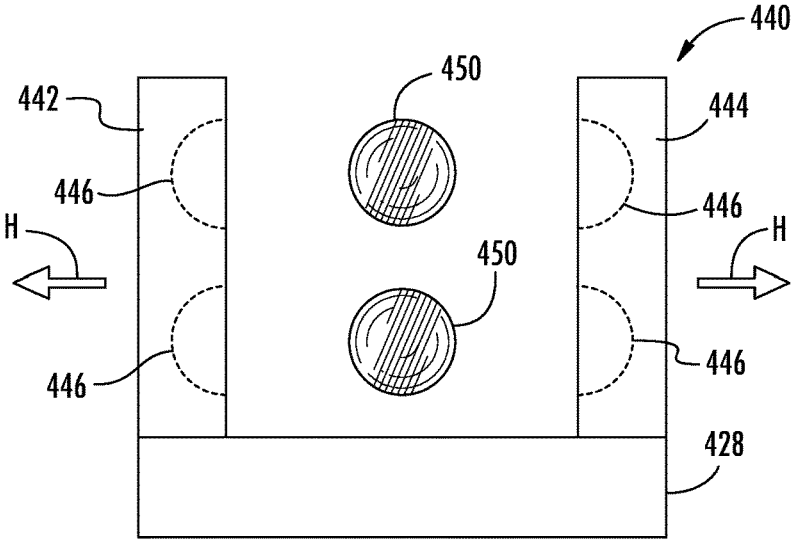
FIG. 8C is a side perspective view of the mold apparatus of FIG. 8A in an open position and a plurality of ice structures.

As shown in FIG. 8C, the mold apparatus 440 has been moved to the open position O by driving the first and second mold assemblies 442, 444 in a direction as indicated by arrows H to release the formed clear ice structures 450 which are shown in FIG. 8C as clear ice spheres. Thus, in the embodiment shown in FIGS. 8-8C, the ice structures 450 are formed in a particularly efficient manner due to the contoured surfaces 412, 414 of the evaporator plate 410. In this way, the apparatus depicted in FIGS. 8-8C is able to carve or otherwise form individual ice structures 450 without having to carve away as much stock ice material as compared to other processes.

Thus, the present invention, with particular reference to FIGS. 1-6, is capable of utilizing a cold plate apparatus to form a sheet of clear ice. After that sheet of clear ice reaches a certain thickness, it is removed from the cold plate apparatus and moved to a staging apparatus. The cold plate apparatus then produces another sheet of ice which is developed to a predetermined thickness. When the second sheet of ice is created, it is removed from the cold plate apparatus and moved to the staging apparatus where it is placed on top of the previously formed ice sheet. In accordance with the present invention, it is contemplated that this process can be repeated multiple times until a certain overall thickness for a unitary ice sheet is achieved. When the predetermined overall thickness is achieved, the ice sheets can be fused together to create a unitary clear ice structure which will be transferred to a mold apparatus to form individual ice spheres as described above.

Figure 9:
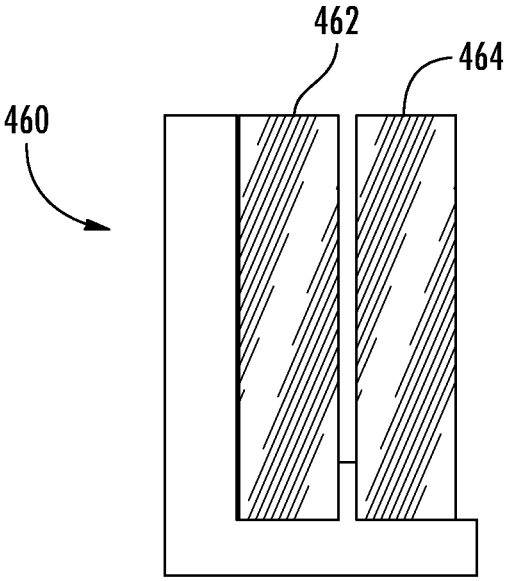
FIG. 9 is a side perspective view of a storage mechanism and stored ice sheets.
Figure 10:
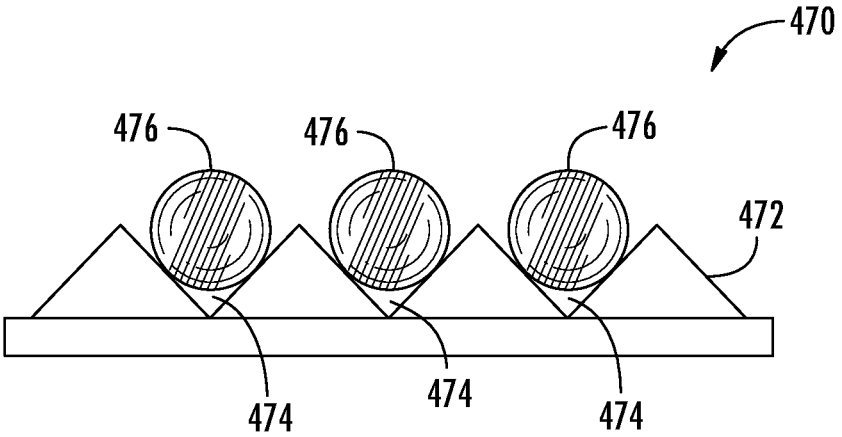
FIG. 10 is a side perspective view of a storage mechanism and stored clear ice structures.

Referring now to FIG. 9, a storage apparatus 460 is shown wherein clear ice sheets 462, 464 can be stored for later use in a fusion process in creating a unitary clear ice sheet. Thus, the storage apparatus 460 is generally disposed downstream of the cold plate apparatus of any given embodiment described above. The storage apparatus 460 will generally be used after an ice sheet is created on a cold plate apparatus, but is not presently required by the ice maker for use in a fusion process. Thus, as shown in FIG. 9, the ice sheets 462, 464 are clear ice sheets which can be prepared in advance and stored in the storage apparatus 460 for later use. In this way, an ice maker incorporating a storage apparatus 460 can continually be ready to prepare a fused clear ice sheet for later forming in a mold apparatus. Further, as shown in FIG. 10, an ice maker may include an ice structure storage apparatus 470 having a contoured surface 472 which provides for compartments 474 for storing individually formed ice structures 476. In this way, the ice structures 476 are separated from one another in the compartments 474 and are kept cool in the storage apparatus 470 for later retrieval by the consumer.

It is also to be understood that variations and modifications can be made on the aforementioned structures and methods without departing from the concepts of the present invention, and further it is to be understood that such concepts are intended to be covered by the following claims unless these claims by their language expressly state otherwise.

What is claimed is:

1. An ice maker comprising:

an evaporator plate having a first side and a second side, wherein water flows over the first side and the second side from a water supply, the first side of the evaporator plate configured to form a first clear ice sheet and the second side of the evaporator plate configured to form a second clear ice sheet;

a staging apparatus arranged downstream from the evaporator plate and configured to receive the first and second clear ice sheets after formation, wherein the first and second clear ice sheets are fused in the staging apparatus to form a unitary clear ice sheet;

a first mold form and a second mold form positioned within the staging apparatus on opposite sides of the unitary clear ice sheet when the unitary ice sheet is received in the staging apparatus; and a mold cavity defined within the first and second mold forms when the first and second mold forms are in an abutting relationship and configured to shape the unitary clear ice sheet to form one or more clear ice structures.

2. The ice maker of claim 1, further comprising:

a storage apparatus disposed downstream from the staging apparatus and configured to receive and store one or more clear ice sheets of a plurality of unitary clear ice sheets.

3. The ice maker of claim 1, wherein the mold cavity comprises at least one spherical cavity configured to form one or more clear ice spheres.

4. The ice maker of claim 1, further comprising:

a heating apparatus configured to heat the first and second mold forms to facilitate the shaping of the unitary clear ice sheet to form the one or more clear ice structures.

5. The ice maker of claim 4, including:

a water reclaiming system in fluid communication with the evaporator plate and configured to capture unfrozen water dispelled from the evaporator plate during the forming of the first and second clear ice sheets.

6. The ice maker of claim 3, wherein the mold cavity includes a pair of cavities that are separated by a planar surface.

7. The ice maker of claim 1, wherein the evaporator plate includes a plurality of associated evaporator plates, wherein each associated evaporator plate is configured to freeze a portion of running water from a water supply into layers to form individual clear ice sheets.

8. An ice maker, comprising:

an evaporator plate having first and second sides configured to form first and second ice sheets respectively thereon;

a water supply configured to run water over the first and second sides of the evaporator plate creating the first and second ice sheets, the first and second ice sheets each having at least one contoured surface;

a staging apparatus configured to position the contoured surfaces of the first and second ice sheets in alignment with one another; and a mold apparatus including a first mold assembly and a second mold assembly, wherein each mold assembly includes one or more mold forms that align to define mold cavities when the mold apparatus is in a closed position and the first and second mold forms are in an abutting relationship, the mold apparatus configured to press the first and second ice sheets towards one another to form one or more individual ice structures.

9. The ice maker of claim 8, wherein the evaporator plate is a vertically oriented evaporator and configured to simultaneously form the first and second ice sheets.

10. The ice maker of claim 9, wherein the first and second sides of the evaporator plate are generally configured to form mirrored first and second ice sheets.

11. The ice maker of claim 8, wherein the first and second sides of the evaporator plate each include a plurality of contoured surfaces.

12. The ice maker of claim 11, wherein the one or more individual ice structures are spherical clear ice structures.

13. An ice maker comprising:

a cooling source having a first side and a second side configured to form first and second ice sheets respectively thereon;

a water supply configured to run water over the first side and the second side of the cooling source;

first and second planar surfaces respectively disposed on the first and second sides of the cooling source;

first and second contoured surfaces respectively disposed above the first and second planar surfaces; and third and fourth contoured surfaces respectively disposed on opposing sides of the first and second planar surfaces from the first and second contoured surfaces.

14. The ice maker of claim 13, further comprising:

a mold apparatus including a first mold assembly and a second mold assembly, wherein each mold assembly includes one or more mold forms.

15. The ice maker of claim 14, wherein the one or more mold forms align to form mold cavities when the mold apparatus is in a closed position.

16. The ice maker of claim 15, wherein the mold apparatus is configured to press the first and second ice sheets towards one another to form one or more individual ice structures within the mold cavities.

17. The ice maker of claim 14, wherein the mold apparatus is heated before the first and second ice sheets are pressed towards one another.

18. The ice maker of claim 13, wherein the cooling source is selected from a group consisting of an evaporator plate, a thermoelectric plate, a cooling loop, a cool air supply, and a heat exchanger.

19. The ice maker of claim 16, wherein the ice structure is formed only on the first and second sides of the cooling source.

20. The ice maker of claim 16, wherein the one or more ice structures are clear ice spheres.

* * * * *